US008496126B2

(12) United States Patent
Mueller et al.

(10) Patent No.: US 8,496,126 B2
(45) Date of Patent: Jul. 30, 2013

(54) SHELVING SYSTEM

(75) Inventors: Paul A. Mueller, Wadsworth, OH (US); Daniel J. Kump, Gates Mills, OH (US)

(73) Assignee: Fasteners For Retail, Inc., Twinsburg, OH (US)

( * ) Notice: Subject to any disclaimer, the term of this patent is extended or adjusted under 35 U.S.C. 154(b) by 2257 days.

(21) Appl. No.: 10/348,306

(22) Filed: Jan. 21, 2003

(65) Prior Publication Data

US 2004/0140278 A1 Jul. 22, 2004

Related U.S. Application Data

(63) Continuation-in-part of application No. 29/171,181, filed on Nov. 18, 2002, now Pat. No. Des. 485,699.

(51) Int. Cl.
*A47F 1/00* (2006.01)

(52) U.S. Cl.
USPC ..... 211/59.3; 312/71

(58) Field of Classification Search
USPC ..... 211/59.3, 184, 59.2, 119.003; 312/71
See application file for complete search history.

(56) References Cited

U.S. PATENT DOCUMENTS

| | | | | |
|---|---|---|---|---|
| 1,971,749 | A | 8/1934 | Hamilton | |
| 2,079,754 | A | 5/1937 | Waxgiser | |
| 2,652,154 | A | 9/1953 | Stevens | |
| 2,678,045 | A | 5/1954 | Erhard | |
| 2,934,212 | A * | 4/1960 | Jacobson | 211/59.3 |
| 3,038,067 | A | 6/1962 | Dench et al. | |
| 3,083,067 | A * | 3/1963 | Vos et al. | 312/71 |
| 3,161,295 | A | 12/1964 | Chesley | |
| 3,308,961 | A | 3/1967 | Chesley | |
| 3,452,899 | A | 7/1969 | Libberton | |
| 3,751,129 | A | 8/1973 | Wright et al. | |
| 3,814,490 | A | 6/1974 | Dean et al. | |
| 3,868,021 | A | 2/1975 | Heinrich | |
| 4,042,096 | A | 8/1977 | Smith | |
| 4,106,668 | A | 8/1978 | Gebhardt et al. | |
| 4,269,326 | A | 5/1981 | Delbrouck | |
| 4,303,162 | A | 12/1981 | Suttles | |
| 4,351,439 | A | 9/1982 | Taylor | |
| 4,378,872 | A | 4/1983 | Brown | |
| 4,488,653 | A | 12/1984 | Belokin | |
| 4,615,276 | A | 10/1986 | Garabedian | |
| 4,724,968 | A | 2/1988 | Wombacher | |

(Continued)

FOREIGN PATENT DOCUMENTS

| | | |
|---|---|---|
| CH | 412251 | 4/1966 |
| DE | 28 25724 | 12/1979 |

(Continued)

OTHER PUBLICATIONS

FFR Yellow Pages 2003 Product Catalog, Cover page, pp. 9, 10, 11, 48, 49, 52, 53, 54, 55, 56, 57, 59 and back cover.

*Primary Examiner* — Alvin Chin Shue
(74) *Attorney, Agent, or Firm* — Fay Sharpe LLP

(57) ABSTRACT

A product pusher device includes an elongate track having a front end, a rear end, and a channel and a paddle movably connected to the track for movement along the channel. The paddle has a front face for engagement with a rearmost one of a set of associated products located on the track. The paddle includes a foot which is slidably engaged in the channel and extends forwardly of the front face. A biasing element urges the paddle toward the track front end.

27 Claims, 11 Drawing Sheets

U.S. PATENT DOCUMENTS

| | | | | | |
|---|---|---|---|---|---|
| 4,730,741 | A | | 3/1988 | Jackle, III et al. | |
| 4,762,236 | A | | 8/1988 | Jackle, III et al. | |
| 4,775,058 | A | | 10/1988 | Yatsko | |
| 4,830,201 | A | | 5/1989 | Breslow | |
| 4,899,893 | A | * | 2/1990 | Robertson | 211/59.3 |
| 4,907,707 | A | | 3/1990 | Crum | |
| 5,111,942 | A | | 5/1992 | Bernardin | |
| 5,161,704 | A | | 11/1992 | Valiulis | |
| 5,190,186 | A | | 3/1993 | Yablans et al. | |
| 5,203,463 | A | | 4/1993 | Gold | |
| 5,240,126 | A | | 8/1993 | Foster et al. | |
| 5,255,802 | A | | 10/1993 | Krinke et al. | |
| 5,351,839 | A | | 10/1994 | Beeler et al. | |
| 5,366,099 | A | | 11/1994 | Schmid | |
| 5,390,802 | A | | 2/1995 | Pappagello et al. | |
| 5,450,969 | A | | 9/1995 | Johnson et al. | |
| 5,469,976 | A | | 11/1995 | Burchell | |
| 5,562,217 | A | * | 10/1996 | Salveson et al. | 211/59.3 |
| 5,634,564 | A | | 6/1997 | Spamer et al. | |
| 5,665,304 | A | | 9/1997 | Heinen et al. | |
| 5,673,801 | A | | 10/1997 | Markson | |
| 5,746,328 | A | | 5/1998 | Beeler et al. | |
| 5,839,588 | A | | 11/1998 | Hawkinson | |
| 5,992,652 | A | * | 11/1999 | Springs | 211/59.3 |
| 6,041,720 | A | | 3/2000 | Hardy | |
| 6,082,557 | A | | 7/2000 | Leahy | |
| 6,105,791 | A | * | 8/2000 | Chalson et al. | 211/59.3 |
| 6,129,218 | A | | 10/2000 | Henry et al. | |
| 6,142,317 | A | * | 11/2000 | Merl | 211/59.3 |
| 6,227,385 | B1 | | 5/2001 | Nickerson | |
| 6,234,328 | B1 | | 5/2001 | Mason | |
| D445,615 | S | | 7/2001 | Burke | |
| 6,382,431 | B1 | * | 5/2002 | Burke | 211/59.3 |
| 6,409,027 | B1 | | 6/2002 | Chang et al. | |
| 6,409,028 | B2 | | 6/2002 | Nickerson | |
| 6,464,089 | B1 | * | 10/2002 | Rankin, VI | 211/59.3 |
| 6,484,891 | B2 | | 11/2002 | Burke | |
| 6,527,127 | B2 | | 3/2003 | Dumontet | |
| 6,533,131 | B2 | | 3/2003 | Bada | |
| D472,411 | S | | 4/2003 | Burke | |
| 6,622,874 | B1 | * | 9/2003 | Hawkinson | 211/59.3 |
| 6,655,536 | B2 | | 12/2003 | Jo et al. | |
| 6,666,533 | B1 | | 12/2003 | Stavros | |
| D485,699 | S | * | 1/2004 | Mueller et al. | D6/408 |
| 6,772,888 | B2 | | 8/2004 | Burke | |
| 7,168,579 | B2 | | 1/2007 | Richter et al. | |
| 2001/0010302 | A1 | | 8/2001 | Nickerson | |
| 2002/0108916 | A1 | | 8/2002 | Nickerson | |
| 2002/0170866 | A1 | | 11/2002 | Johnson et al. | |
| 2003/0057167 | A1 | | 3/2003 | Johnson et al. | |
| 2003/0085187 | A1 | | 5/2003 | Johnson et al. | |
| 2003/0141265 | A1 | | 7/2003 | Jo et al. | |
| 2003/0217980 | A1 | | 11/2003 | Johnson et al. | |
| 2004/0079715 | A1 | | 4/2004 | Richter et al. | |

FOREIGN PATENT DOCUMENTS

| | | |
|---|---|---|
| EP | 270016 | 6/1988 |
| EP | 986980 | 3/2000 |
| FR | 2526338 | 5/1982 |
| FR | 2617385 | 1/1989 |
| GB | 2027339 | 2/1980 |
| GB | 2290077 | 12/1995 |
| JP | 59-218113 | 12/1984 |
| WO | WO 02/091885 | 11/2002 |

* cited by examiner

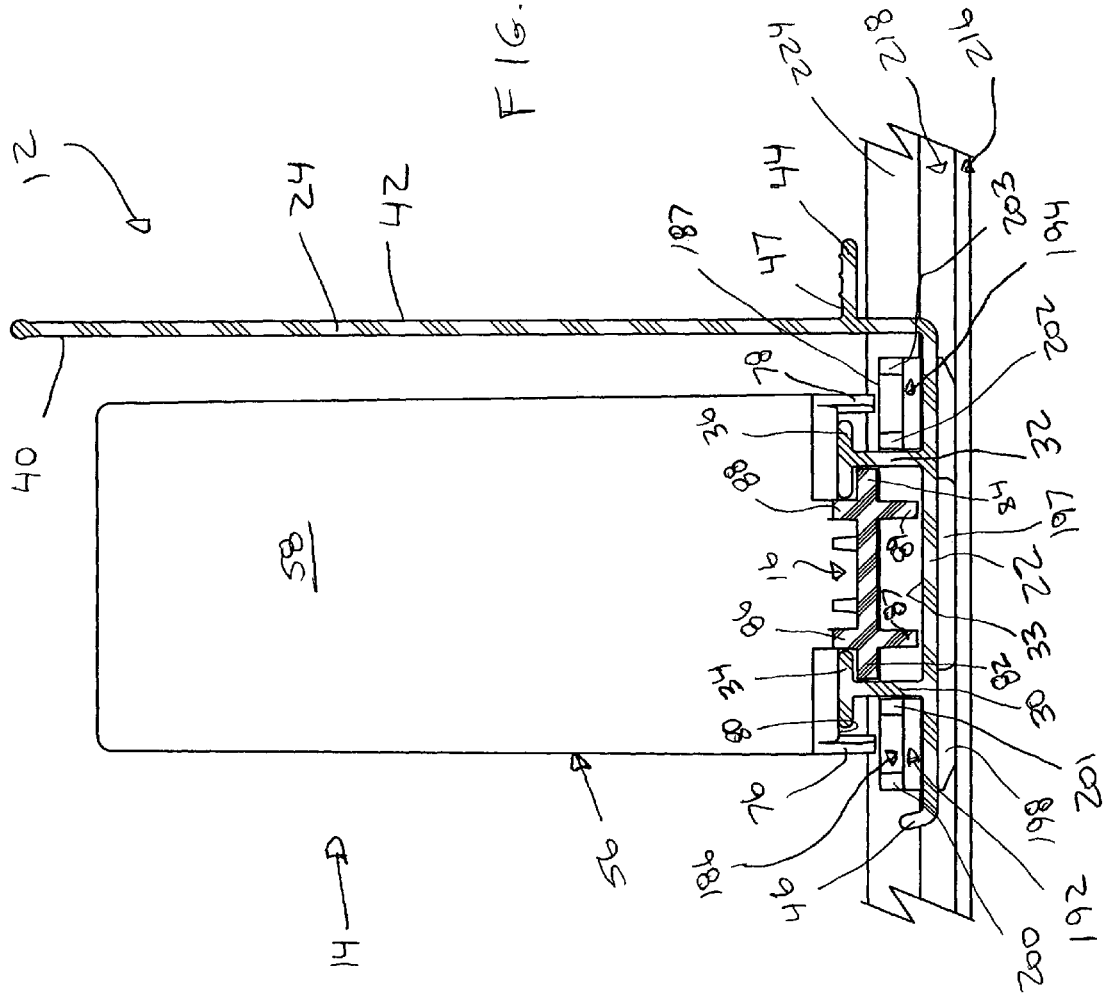
21
40
42
24
58
95
14
78
76
96
98
91
88
86
34
36
28
30
32
22
48
18
20
26
102
104
106
108
110
112
114
116
118
120
122
124
126
128
130
132
134
136
138
140
142
144
146
148
150
152
154
156
158
160
162
164
166
168
170
172
174
176
178
180

SHELVING SYSTEM

This application is a continuation-in-part of patent application Ser. No. 29/171,181 filed on Nov. 18, 2002. That Application issued as Design Pat. No. D485,699 on Jan. 27, 2004.

FIELD OF THE INVENTION

The present invention generally relates to an adjustable shelving system. More specifically, the present invention relates to an adjustable forward-feeding display shelving system for storing and displaying merchandise of a variety of shapes and sizes and automatically delivering the merchandise to the front of the shelf The shelving system removably attaches to an associated shelf and is configured to accommodate more merchandise on the shelf

BACKGROUND OF THE INVENTION

Shelving is used extensively for stocking and storing products or merchandise in a variety of stores. Most stores have immovable shelving which is arranged back-to-back between aisleways. The nature of the fixed shelves makes it difficult to add and remove products. Moreover, such shelves make difficult the rotation of the shelved products, which involves moving the older stock to the front of the shelf and positioning new stock behind the older stock. For a number of important merchandising considerations, it is desirable that merchandise be displayed at the front of a shelf so that the customer is induced to purchase such forwardmost article. For example, if the goods are perishable or are subject to becoming stale (e.g. cigarettes, fruit juices, dairy products, or any item with an expiration date or a freshness date), it is important that the articles be removed in a first in, first out basis to maintain freshness. Also, if merchandise is not displayed at the front of a shelf, it may not catch the shopper's eye, which may cost the merchant sales.

In order to automatically move an item forward as the one before it is removed, numerous forward feed devices have been devised. There devices generally fall into three categories. The first category is inclined tracks, relying on gravity to feed, slide, or roll products forward. Gravity feeding is unpredictable in that various materials slide easier than others because of different weights and frictional interfaces between the products and the track. The second category employs conveyor belts which still use gravity to effect forward movement. These devices typically are cumbersome, expensive, and complicated, due to the need to properly tension and track the conveyor belts. The third category uses spring-biased paddles to feed the product forward. Such paddle-based forward feed devices have been found useful for certain merchandise.

However, a merchant with two or more different depths of shelving must purchase tracks of two or more depths, to employ the spring-biased paddles. There thus exists a need for a track system that is capable of accommodating shelving of varying depths.

Accordingly, it has been considered desirable to develop a new and improved track system for merchandise display which would overcome the foregoing difficulties and others while providing better and more advantageous overall results.

SUMMARY OF THE INVENTION

In accordance with the present invention, a new and improved shelving system assembly is provided. One aspect of the shelving system comprises a product pusher device including an elongate track having a front end, a rear end, and a channel. A paddle is movably connected to the track for movement along the channel. The paddle has a front face for engagement with a rearmost one of a set of associated products, located on the track. The paddle further comprises a foot which is slidably engaged with the channel. The foot extends forwardly of the front face of the paddle. A biasing element urges the paddle toward the front end of the track.

A further aspect of the present invention includes a product pusher device comprising an elongate track having a front end, a rear end, a channel, and a length for placement on an associated shelf. The shelf has a depth and a length wherein the track extends generally transverse to the length of the associated shelf. The associated shelf's depth is greater than the length of the track. The track supports a plurality of associated products thereon. A paddle is movably connected to the track for movement along the channel and includes: a front face for engagement with a rearmost one of the associated products positioned on the track, a foot slidably engaged in the channel, wherein the paddle is adapted to cantilever beyond the rear end of the track, and a biasing element for urging the paddle toward the front end of the track.

Another aspect of the present invention involves a product pusher assembly comprising a first elongate track having a front end, a rear end, a base wall, and a side wall. The first track side wall includes a first face and a second face. A flange extends generally transverse to the second face of the first track side wall. A paddle is movably connected to the first track for movement along the track. The paddle includes a front face for engagement with a rearmost one of a set of associated products located on the track. The product pusher assembly further comprises a second elongate track which includes a front end, a rear end, a base wall, and a side wall. The second track base wall and the first track side wall flange cooperate to support a plurality of associated products along the second track.

A still further aspect of the present invention includes a product pusher assembly comprising a first elongate track having a front end, a rear end, a channel, and a length for placement on an associated shelf having a depth and a length. The first track extends generally transverse to the length of the associated shelf and includes a front clip and a rear clip. The assembly further comprises a second elongate track having a front end, a rear end, a channel, and a length for placement on the associated shelf, spaced from and parallel to the first track. The second track includes a front clip. A front panel mounted on the associated shelf includes a wall and a flange which cooperate to define a slot therebetween. A rear panel is mounted on the associated shelf and comprises a wall and a flange which cooperate to define a slot therebetween. The first track front and rear clips are slidably mounted in the front and rear panel slots for movement along the length of the associated shelf. The second track front clip is slidably mounted in the front panel slot, but the second track can be pivoted away from the rear panel for selective removal of the second track from the front panel and the associated shelf. Yet a still further aspect of the present invention includes a product pusher assembly for wide products selectively held on a shelf comprising a first track having a channel and a first paddle slidably mounted in the first track channel. The first paddle comprises a base, a front face mounted to the base, and a foot extending forwardly of and mounted to the base. The assembly further comprises a second track having a channel and a second paddle slidably mounted in the second track channel. The second paddle comprises a base and a front face mounted to the base. The second track is selectively positioned on an associated shelf alongside the first track so that the second paddle can assist the first paddle in pushing an associated product forward on the associated shelf.

Still other benefits and advantages of the present invention will become apparent to those of average skill in the art upon reading and understanding of the following detailed specification.

BRIEF DESCRIPTION OF THE DRAWINGS

The invention may take physical form in certain parts and arrangements of parts, several embodiments of which will be described in detail in this specification, and illustrated in the accompanying drawings, which form a part hereof and wherein:

FIG. 11 is a sectioned view through the shelf management system of FIG. 1A in accordance with the first embodiment of the present invention;

DETAILED DESCRIPTION OF THE PREFERRED EMBODIMENTS

Figure 1A:
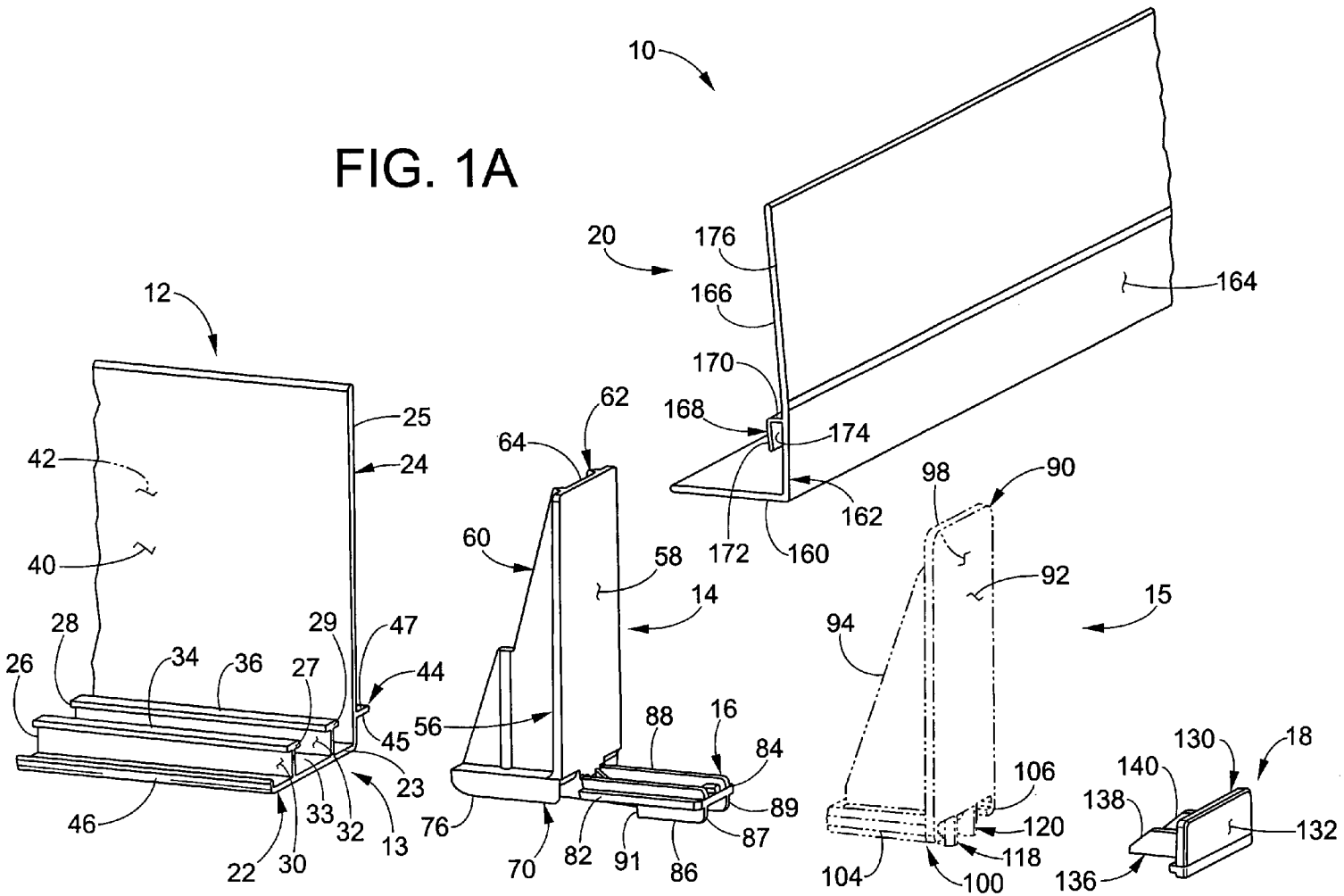
FIG. 1A is an exploded perspective view of a shelf management system according to the present invention, including a portion of an elongate track, two paddles in accordance with a first and a second embodiment, a front panel, and a front end clip.
Figure 1B:
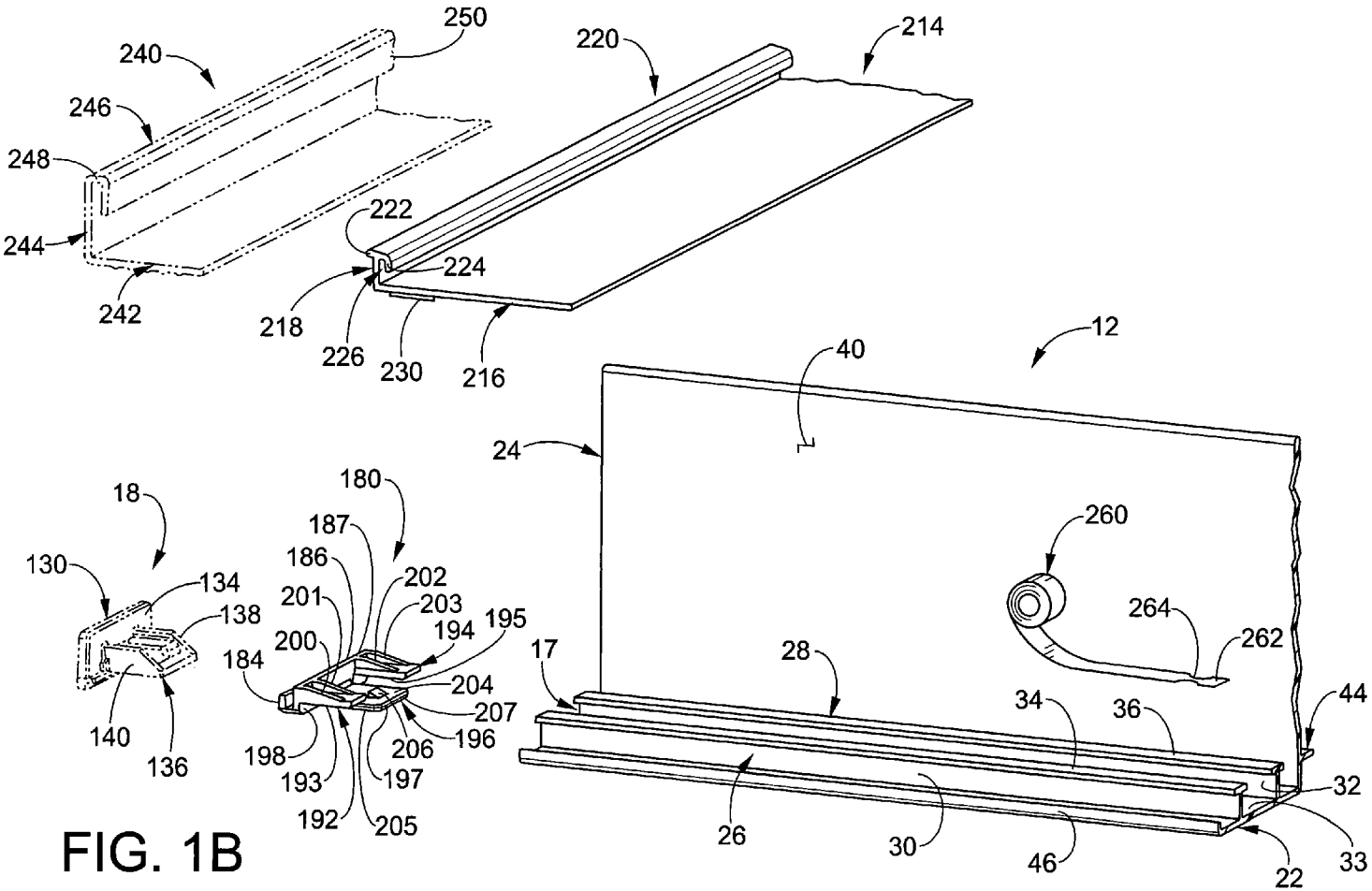
FIG. 1B is an exploded perspective view of a merchandise shelving system according to the present invention, including a portion of the elongate track, two rear panels and two rear end clips in accordance with the first and second embodiments.

Referring now to the drawings, wherein the showings are for the purposes of illustrating several preferred embodiments of the invention only and not for purposes of limiting same, FIGS. 1A and 1B show two embodiments of the shelf management system according to the present invention.

More particularly, FIG. 1A shows an exploded view of the components comprising a shelving system generally designated by reference numeral 10 including a portion of an elongate track 12, a product pusher paddle 14 with a foot 16 in accordance with a first embodiment, a front end clip 18, and a front panel 20. Also shown in phantom lines is an alternative product pushing paddle 15 without the foot in accordance with a second embodiment. The components of the shelving system 10 could be formed in accordance with the present invention from a conventional thermoplastic, such as polyvinyl chloride plastic or any other suitable plastic by extrusion, molding, or any suitable plastic forming technique. The shelving system 10 is configured in such a way so as to accept packages of various widths, depths, and configurations. More particularly, the spacing between adjacent tracks 12 can be adjusted to accommodate packages of different widths. Also, the shelving system can be employed on shelves of differing depths.

The track 12 is generally configured in an elongate orientation, including a front end portion 13 and a rear end portion 17,as shown in FIGS. 1A and 1B, respectively. The track 12 includes a base wall 22 and a side wall 24. The base wall 22 and the side wall 24 are perpendicular to each other. The base wall 22 of the track 12 includes a pair of T-shaped rails 26, 28 thereon. The T-shaped rails 26, 28 each include a vertical leg 30, 32, respectively extending transverse to an upper surface 33 of the base wall 22. The vertical legs 30, 32 each have a flattened horizontal surface 34, 36, respectively thereon. The flattened horizontal surfaces 34, 36 increase the support surface area for carrying product without impeding the sliding movement of product along the horizontal surfaces 34, 36 utilizing the available forces provided by the product feeding shelving system. The vertical legs 30, 32 space the flattened horizontal surfaces 34, 36 from the upper surface 33 of the base wall 22. The T-shaped rails 26, 28 extend collinear with the length of the track 12.

The track 12, at one side, includes the side wall 24 extending perpendicular to the base wall 22. The side wall 24 functions as a divider member to separate the shelf space into individual merchandise display areas. The side wall 24 includes a first face 40, a second face 42, and a flange 44. The flange 44 is generally transverse to the second face 42 of the side wall 24. The flange 44 is collinear with the length of the track 12. The flange 44 is proximal to the base wall 22 and generally coplanar with the flattened horizontal surfaces 34, 36 of the T-shaped rails 26, 28. The flange 44 has a horizontal surface 47. The base wall 22, at another side, includes a terminal edge 46, distal to the side wall 24, which extends upward generally perpendicular to the base wall 22. The terminal edge 46 is collinear with the length of the track 12. The front edges of the rails 27, 29, the front edge of the base wall 23, the front edge of the side wall 25, and the front edge of the flange 45 are coplanar and aligned generally with the front edge of the associated shelf, not shown.

As shown in FIGS. 1A, 6, 7, and 11, the paddle 14 according to the first embodiment includes the foot 16. The paddle 14 further includes a pusher wall 56 with a front face 58 and a pair of gussets 60, 62 which extend rearwardly from a rear face 64. These are generally angled from the top of the pusher wall 56 to a base 70 of the paddle 14. The gussets 60, 62 serve to stiffen the pusher wall 56. The foot 16 extends forward of the pusher wall front face 58. An upper surface (shown in FIG. 2) of the base 70 serves as a spring carrier surface 72. At opposing sides of the spring carrier surface 72 are a pair of outside edges 76, 78 projecting downward generally perpendicular to the spring carrier surface 72. The outside edges 76, 78 are parallel to one another and are spaced to slidably engage, along with an underside or sliding surface 80 of the spring carrier surface 72, the flattened horizontal surfaces 34, 36 of the T-rails 26, 28. The foot 16 extends forwardly transverse to the front face 58 of the pusher wall 56. The foot 16 includes a pair of opposing outside flanges 82, 84. A pair of product supporting arms 86, 88 are included on a top surface of the foot 16. A pair of guide legs 87, 89 are included on a bottom surface of the foot 16. The arms 86, 88 and legs 87, 89 are collinear with T-rails 26, 28 when the shelving system 10 is in an assembled arrangement, as will be described hereinafter.

Figure 8:
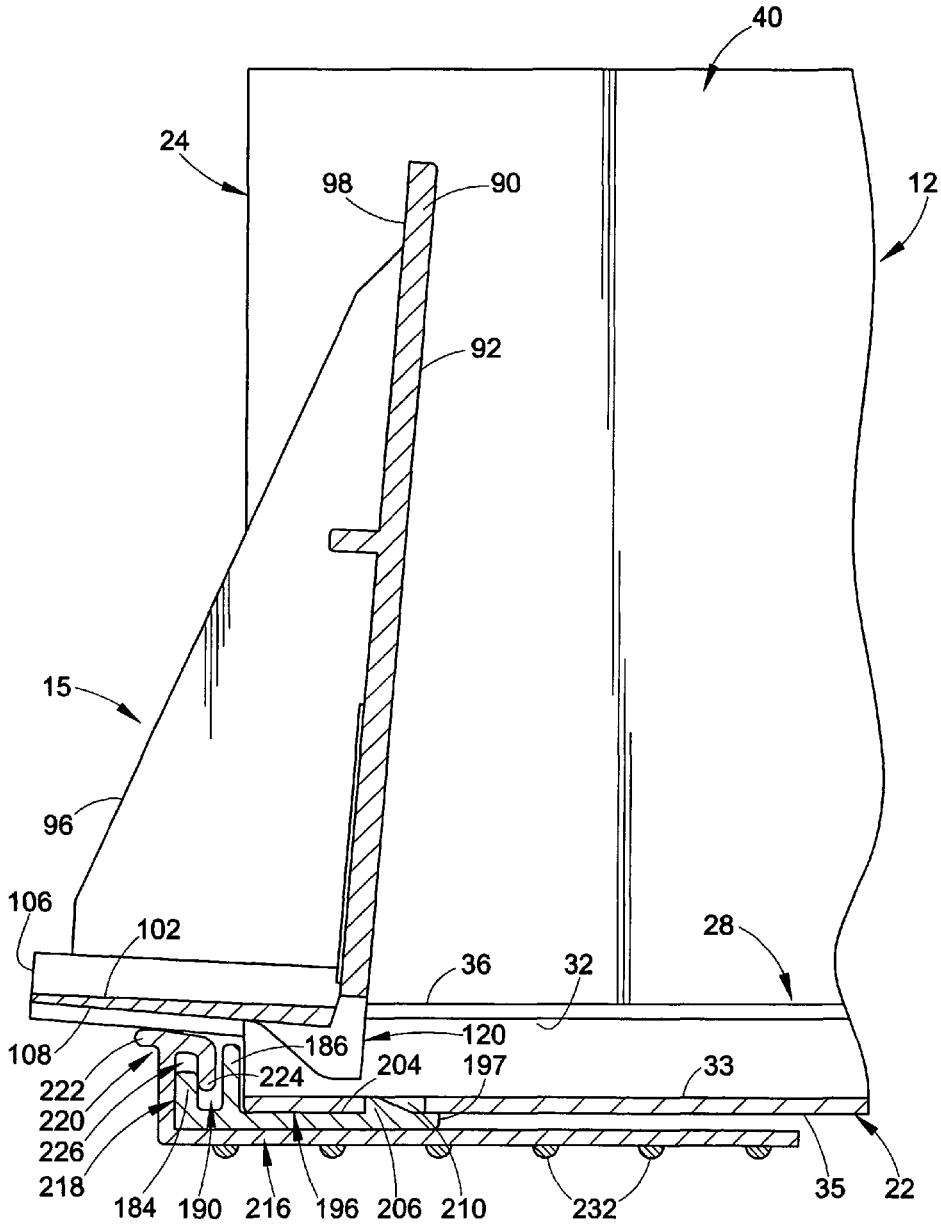
FIG. 8 is an enlarged sectioned view through a rear portion of the shelf management system according to a second embodiment of the present invention.
Figure 9:
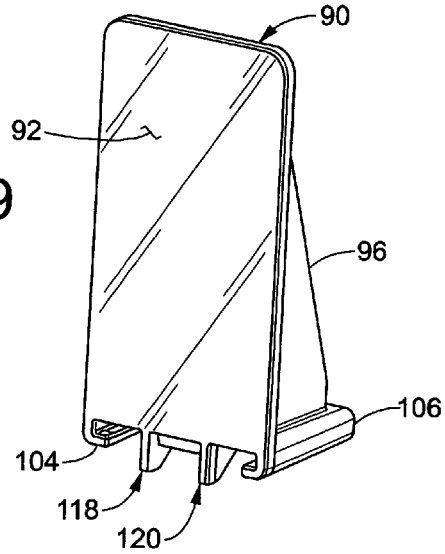
FIG. 9 is a perspective view of a paddle according to the second embodiment of the present invention.

As shown in FIGS. 1A, 8, and 9, the second embodiment of the paddle 15 does not include a foot. However, the paddle 15 does include a pusher wall 90 with a front face 92 and a pair of gussets 94, 96 extending rearwardly from a rear face 98. These generally angle from the top of the pusher wall 90 to a base 100 of the paddle 15. The gussets 94, 96 serve to stiffen the pusher wall 90. An upper surface of the base 100 serves as a spring carrier surface 102 (see FIG. 8). At opposing sides of the spring carrier surface 102 are a pair of rolled edges 104, 106 projecting downwardly and inwardly. The base 100 also includes a pair of legs 118, 120 extending transverse to a lower or sliding surface 108 of the base 100. The legs 118, 120 are configured to slidably engage the upper surface 33 of the base wall 22 to support and align the paddle 15 along the track 12.

Figure 2:
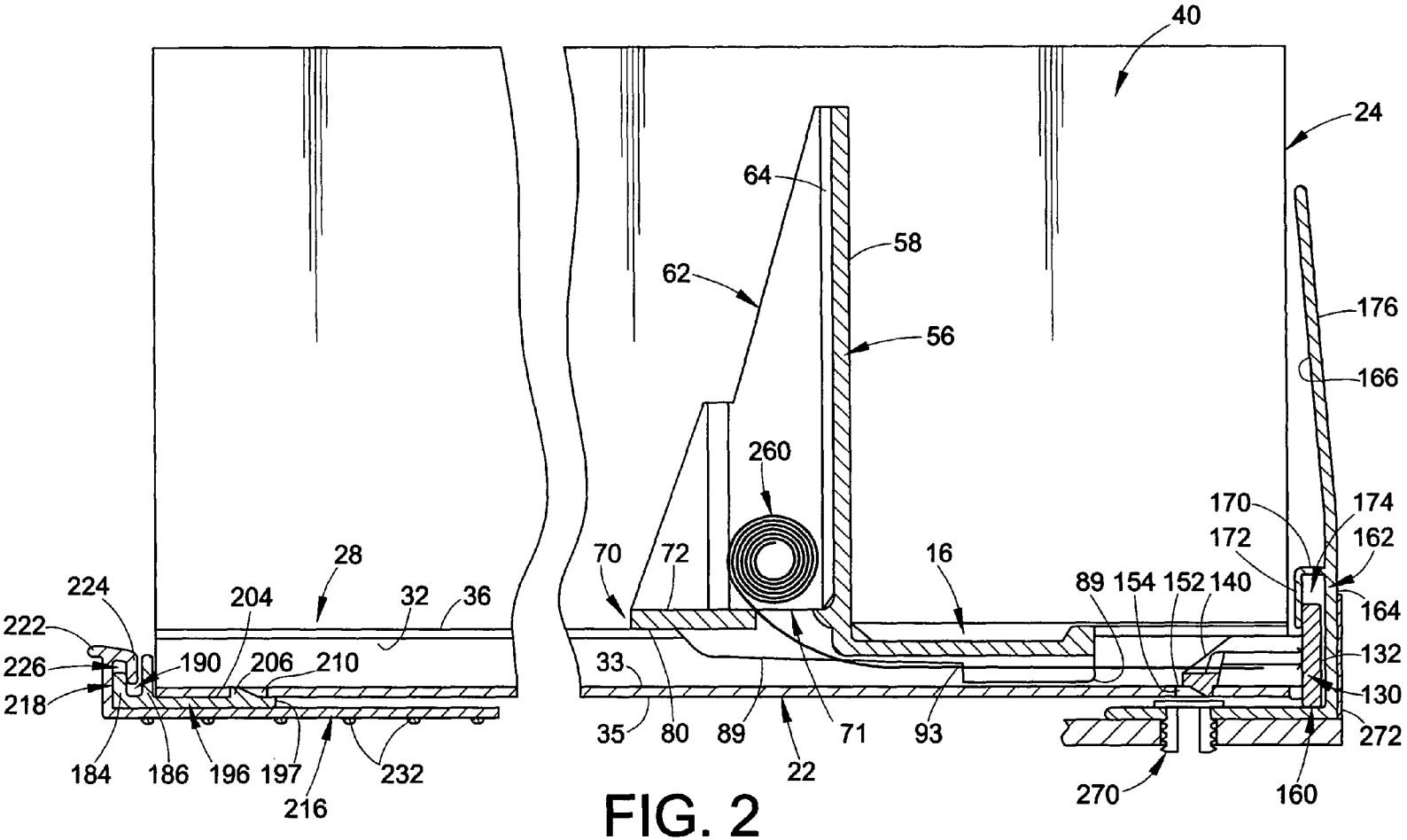
FIG. 2 is a sectioned view through the shelf management system of FIG. 1 in accordance with the first embodiment of the present invention.
Figure 5:
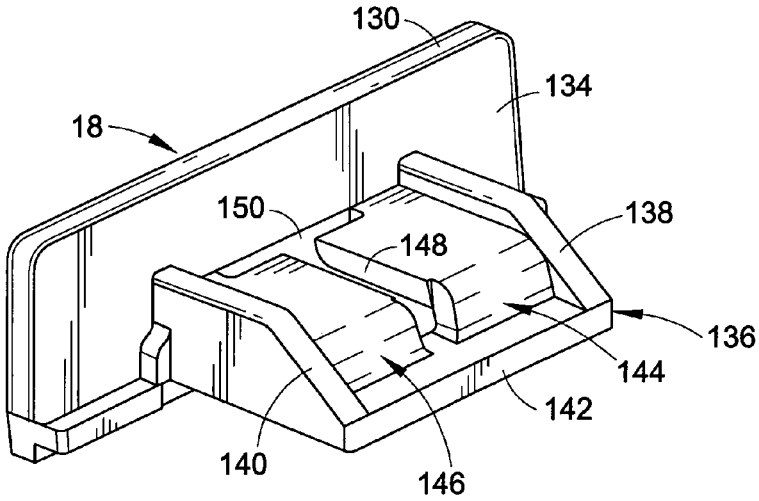
FIG. 5 is an enlarged perspective view of the front end clip according to the present invention.
Figure 6:
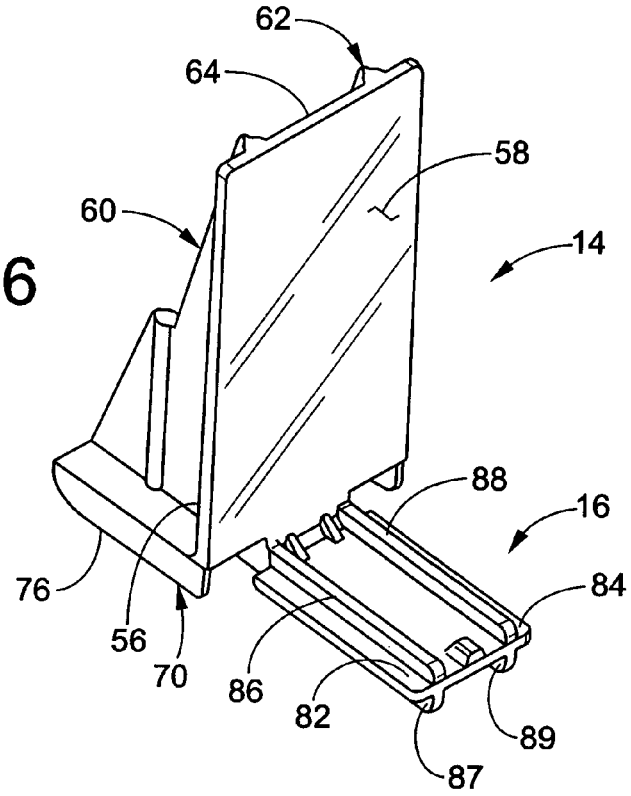
FIG. 6 is a top perspective view of a paddle with an extension according to the first embodiment of the present invention.

With reference now to FIG. 1A and FIG. 5, a front end clip 18 for each track 12 is shown. This includes a vertical rectangular front plate 130 with a front face 132 and a rear face 134. The front plate 130 includes a mounting element 136 extending transverse to the rear face 134 of the plate 130. The mounting element 136 comprises a pair of vertically oriented opposing side walls 138, 140 and a bottom wall 142. Additionally, a pair of raised areas 144, 146 are contained between the side walls 138, 140. The raised areas 144, 146 define between them a T-shaped slot having a stem 148 and a head 150. The mounting element 136 of the front end clip 18 slides in between the T-rails 26, 28 in the front end portion 13 of the track and frictionally engages legs 30, 32, flattened horizontal surfaces 34, 36 and the upper surface 33 of the base wall 22. As shown in FIG. 2, a tooth 152 protrudes from a lower face of the clip and engages in a slot 154 in the track to fix the front end clip 18 to the front end portion 13 of the track 12 without the use of any glue or other adhesive material.

Also shown in FIG. 1A is the front panel 20. The front panel 20, which can be an extruded piece, is cut to fit the length of the shelf. The front panel 20, and a rear panel described hereinafter, generally allow the product tracks 12 to be stably held so as to define a width for the product as well as to hold the product tracks 12 to the shelf at both the front and the back ends of the shelf, yet allowing them to slide sideways on the shelf. The front panel 20 and rear panel are advantageously configured such that a plurality of product tracks 12 can be slidably mounted to them. The front panel 20 is generally configured in an L-shaped arrangement with a base wall 160 and a front wall 162 extending upward generally transverse to the base wall 160. The front panel 20 may be comprised of a clear plastic material to allow a merchant or prospective purchaser a clear line of vision to the product being carried by the shelving system. The front wall 162 includes a front face 164 and a rear face 166. A downward extending flange 168 projects from the rear face 166 of the front panel 20. The flange 168 includes a first leg 170 which extends perpendicular to the rear face 166 and a second leg 172 generally perpendicular to the first leg 170. The second leg 172 extends downward generally parallel to the rear face 166. The first leg 170 and the second leg 172 form the downward extending flange configuration which provides an open slot 174. The open slot 174 is configured to receive the front plate 130 of the front end clip 18. An upper portion 176 of the front wall 162 serves as a product retaining wall which extends upward and preferably angles slightly rearward from a location above the flange 168. The product retaining wall 176 serves as a forwardmost stopping surface for the shelf management system 10 and utilizes the rearward angle to hold products within the adjustable shelf management system 10 while the product is being urged forward in the manner described in greater detail hereinafter.

Figure 3:
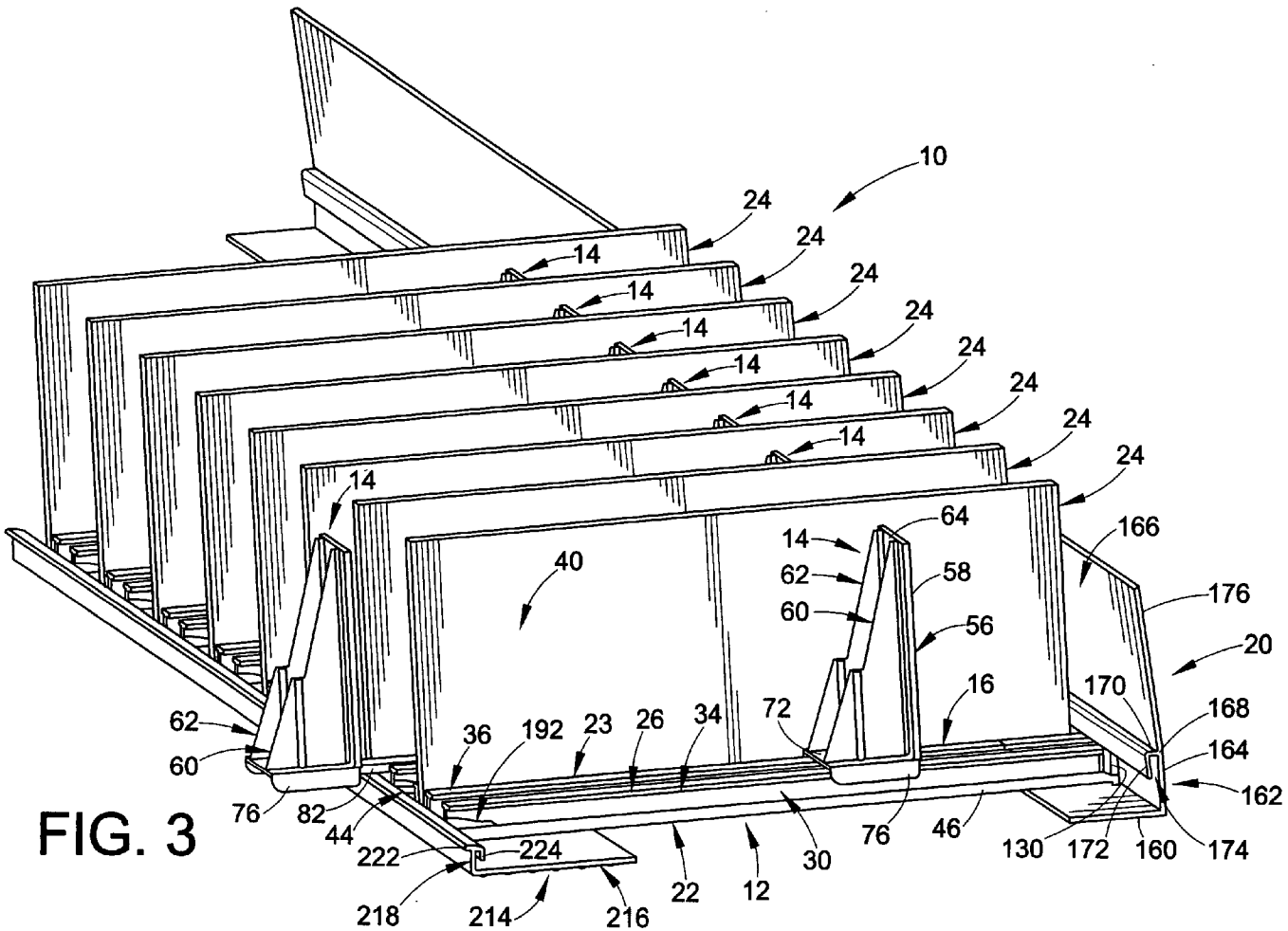
FIG. 3 is an assembled perspective view of the shelf management system of FIG. 1 in accordance with the first embodiment of the present invention.
Figure 4:
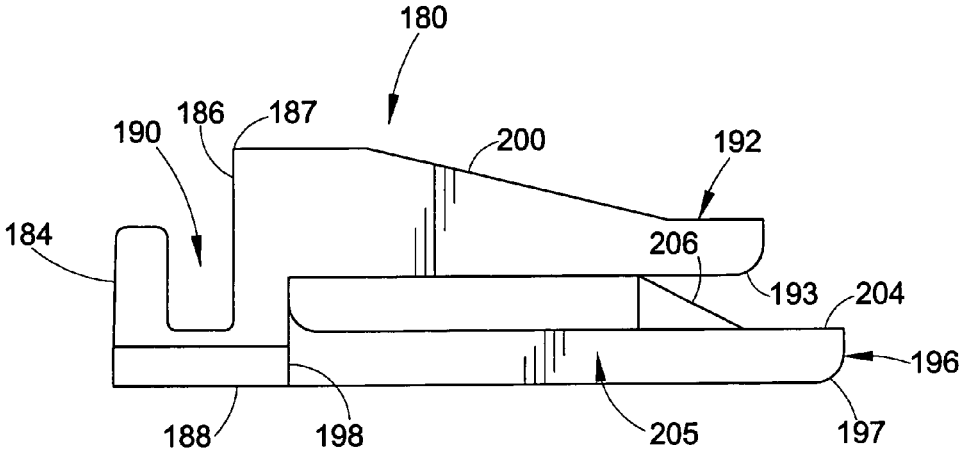
FIG. 4 is an enlarged side elevational view of a rear end clip according to the first embodiment of the present invention.

As shown in FIG. 1B, a low profile rear end clip 180 cooperates with a low profile rear panel 214 in the first embodiment of the present invention. With reference now to FIG. 3, these two elements are configured in such a way as to allow a rear end of the pusher paddle 14 to extend rearward beyond the rear end portion 17 of the track 12. However, the foot 16 holds the pusher paddle on the track. As shown in FIG. 4, the low profile rear end clip 180 includes vertically extending first and second walls 184, 186, respectively. A horizontal connecting wall 188 connects the first and second walls 184, 186 at their respective bottom edges thereby defining an upwardly open slot 190 between the first 184 and second 186 walls. Extending transverse to the second wall 186 are two opposing upper mounting tabs 192, 194 (see FIG. 1B) at opposing ends of the second wall 186. A lower mounting tab 196 extends transverse to the second wall 186 centered along a lower edge 198 of the second wall 186 between the two upper mounting tabs 192, 194. The two upper mounting tabs 192, 194 have planar bottom surfaces 193, 195, respectively. Each upper mounting tab 192, 194 includes a pair of integrally formed support walls 200, 201 and 202, 203, respectively, extending from a top edge 187 of the second wall 186 angularly to the front edge of the tabs. The planar bottom surfaces 193, 195 are configured to slidingly engage the upper surface 33 of the track base wall 22. The lower mounting tab 196 has a planar upper surface 204 including an upward projecting tooth 206 generally centered between the side edges 205, 207 of the lower mounting tab 196 proximal to a front edge 197. The upper surface 204 of the lower mounting tab 196 is configured to slidingly engage the bottom surface 35 of the track base wall 22. As shown in FIGS. 2 and 8, the upward projecting tooth 206 engages an opening 210 in the base wall 22 between the T-rails 26, 28 thereby preventing disengagement of the rear end clip 180 from the track 12.

As shown in FIG. 1B, the low profile rear panel 214 of the first embodiment is defined by a base wall 216 and an upwardly extending rear wall 218. The rear wall 218 extends transverse to the base wall 216 and includes an L-shaped upper edge 220. The L-shaped upper edge 220 has a first leg 222 generally perpendicular to the rear wall 218 and a second leg 224 extending downward generally parallel to the rear wall 218. The first leg 222 and the second leg 224 form a downwardly open channel 226. The channel 226 is configured to engage the first vertically extending wall 184 of the rear end clip 180. As with the front panel, the rear panel 214 is cut to the length of the shelf and accommodates a plurality of product tracks 12. The base wall 216 of the rear panel 214 may include anti-skid layer 230 extending along the length of the bottom side of the base wall 216 proximal to the rear wall 218 for preventing movement of the rear panel in relation to the shelf. Alternatively, as shown in FIG. 2, a set of anti-skid bumps 232 may be used. The layer 230 or bumps 232 can be co-extruded or separately applied to the rear panel 214.

With reference now to the second embodiment, the front end clip 18 may be utilized also as the rear end clip as shown in FIG. 1B. For this purpose, a second embodiment of a rear panel 240 is employed. In this embodiment, the rear panel 240 includes a base wall 242 and a rear wall 244. The rear wall 244 projects upwardly transverse to the base wall 242. The rear wall 244 includes an L-shaped upper edge 246. The L-shaped upper edge 246 includes a first leg 248 projecting transverse to the rear wall 244 in a forward direction. A second leg 250 projects downward, generally parallel to the rear wall 244, from the first leg 248. In this embodiment, the rear panel 240 is similar to the front panel 20 but without a product retaining wall (upper portion).

Figure 7:
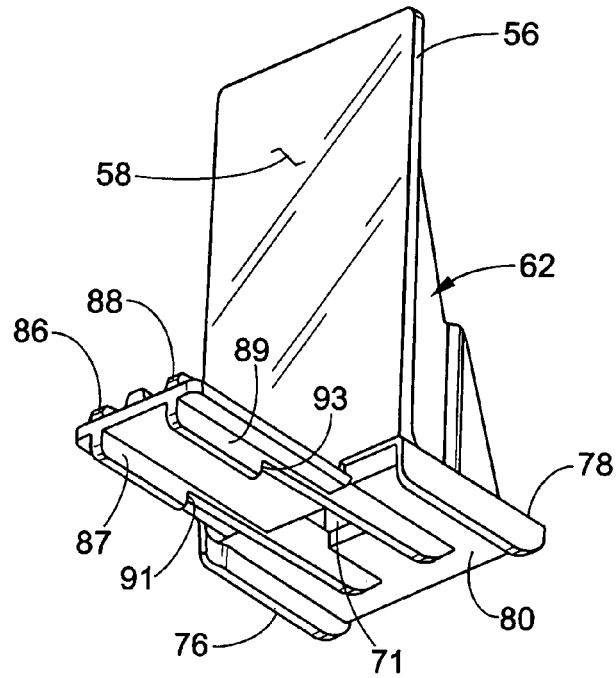
FIG. 7 is a bottom perspective view of the paddle of FIG. 6.

According to the first embodiment, the paddle 14 is in sliding connection with the product track 12 (best shown in FIGS. 2, 3, and 11). The sliding connection comprises a first and second pair of surfaces, with the first pair located adjacent the first T-shaped rail and the second pair of surfaces located adjacent the second T-shaped rail. One surface of the first and second pairs is formed on the top side of the outside flanges 82, 84 of the foot. The other surface of each of the first and second pairs is on the upper surfaces of the T-rails 26, 28. The first and second pairs of surfaces engage to resist separation of the paddle from the track. Additionally, there is a third pair of surfaces 87, 89 located on the bottom side of the foot 16 (see FIGS. 7 and 11). These engage adjacent surface 33 on the track base wall 22 to maintain alignment of the paddle 14 with the track 12. Furthermore, there is a fourth pair of surfaces located on the bottom side of the foot. These include notches 91 and 93, as shown in FIG. 7. The notches engage a surface of the rear end clip 180 to halt rearward travel of the paddle on the track.

As illustrated in FIG. 2, the front face 58 of the paddle 14 extends generally normal to the upper surface 33 of the track 12. The front face 58 of the paddle is designed to allow the paddle to maintain contact with the products positioned directly in front of it. The spring carrier surface 72 and the sliding surface 80 of the paddle 14 are generally formed from the same section of material which extends rearward of the pusher wall 56 along a direction generally perpendicular to the front face 58. In the illustrated embodiment in FIGS. 2, 6, and 7, the gussets 60, 62 support the relationship between the pusher wall 56 and the base 70. The outer edges 76, 78 of the base 70 extend downward transverse to the spring carrier surface 72. These outer edges 76, 78 form a fifth pair of sliding surfaces. These cooperate with a respective surface of the track 12. The fifth pair of surfaces engage to maintain alignment of the paddle 14 with the track 12. The base 70 includes a central opening 71, proximate to the rear face 64, which allows a roll spring to pass therethrough.

With reference again to FIG. 1A, the opposing outside flanges 82, 84 are designed to slide under the flattened horizontal surfaces 34, 36 of the rails 26, 28. The sliding surface 80 (FIG. 2) of the paddle 14 is designed to slide over the flattened horizontal surfaces 34, 36 of the rails 26, 28. Through the use of the opposing flanges 82, 84 (FIG. 6), the opposing outside edges 76, 78, and the rails 26, 28 of the track 12, a slidable positive lock between the track 12 and the paddle 14 is formed. The slidable positive lock reduces the likelihood of the paddle 14 separating or misaligning from the track 12 under high load.

As shown in FIG. 1A, the second embodiment of the paddle 15 (phantom lines) comprises first and second rolled edges 104, 106 which, in use, are located adjacent the rails 26, 28 of the track. These cooperate with the respective adjacent track 34, 36. The rolled edges engage the tracks to maintain alignment of the paddle with the track. Additionally, the legs 118, 120 of the second paddle 15 engage adjacent portions of the respective T-rails 26, 28. Such engagement helps resist separation of the paddle from the track.

The pushing surface or front face 92 extends generally normal to the upper surface 33 of the base wall 22. The spring carrier surface 102 and the sliding surface 108 are generally formed from the same section of material which extends rearward of the rear face 98 of the pusher wall 90 along a direction generally perpendicular to the front face 92 or pushing surface. In the illustrated embodiment in FIGS. 1A and 8, a pair of gussets 94, 96 support the relationship between the pusher wall 90 and the base 100 of the paddle 15.

In both embodiments, a biasing element in the form of a spring 260 is used to bias the paddle 14 toward the front end portion 13 of the track 12. As illustrated in FIG. 2, the biasing element can be a roll spring 260. The roll spring 260 has characteristics which may make it desirable over various other types of springs, such as compression springs. For instance, the roll spring 260 naturally recoils back into its tightly wound initial state after being extended and released. Also, as the roll spring 260 is stretched, the force exerted by it is approximately the same during such stretching. It will be appreciated that other biasing elements may be used, i.e. elastic straps, coil springs, and other biasing members. The roll spring 260 is advantageous because it provides a uniform force throughout its extension, is simple to install, and does not require attachment to the foot 16. The roll spring 260 may be permanently, semi-permanently, or removably attached to the front clip 18. In the embodiment illustrated, the roll spring 260 is semi-permanently attached to the clip 18 by inserting a first end 262 of the spring 260 into the head 150 of the slot in the clip. A spring portion 264 immediately adjacent the first end 262 is then bent 90° and inserted into the stem 148 of the clip. The remainder of the spring is then rotated 90° around its longitudinal axis.

The balance of the roll spring 260 rests on a spring carrying surface 72 of the base 70 of the paddle 14. Due to the configuration of the roll spring 260, it does not need to be secured to the spring carrier surface 72. Alignment of the coiled section of the roll spring 260 is maintained by the rear face 64 of the pusher wall 56, and the inside walls (not shown) of the gussets 60, 62. The rear face 64 of the pusher wall 56 provides a front support and the inside walls of the gussets 60, 62 provide side restraints with respect to movement of the roll spring 260.

With reference again to FIG. 2, it is appreciated that in the first embodiment, the foot 16 of the paddle 14 limits the forward travel of the paddle 14. Although the forward travel of the paddle is inhibited by the foot 16, the foot 16 enables the pusher wall 56 to extend rearward beyond the rear portion 17 of the track 12 (as seen in FIG. 3). This additional rearward travel of the paddle 14 allows the entire length of the track to be utilized for storing and moving products. It will be appreciated that, in the second embodiment, using the paddle 15, the paddle 15 can traverse substantially the entire length of the track 12 but the pusher wall 90 does not travel beyond the rear end of the track 12 (as seen in FIG. 8).

The shelf management system 10 comprises the track 12 to underlie a plurality of products. The track 12 extends longitudinally between the front and rear end portions 13, 17, and laterally between the terminal edge 46 and the side wall 24. As illustrated in FIG. 3, the shelving system 10 and feeding assembly generally comprises a number of product tracks 12. It will be appreciated that the base walls 160, 216, 242 of the front and rear panels are of sufficient depth in order to provide the necessary stability and alignment to the product tracks extending therebetween. Due to the use of T-rails 26, 28 product tracks 12 decrease the contact surface area between the packages and the product supporting and feeding assembly such that friction may be reduced between the products and the assembly. The horizontal surface 47 of flange 44 of a first track 12 is coplanar with the flattened horizontal surfaces 34, 36 of a second adjacent track 12 to improve the product support and alignment as the products move along the track 12.

With reference now to FIGS. 2 and 3, a plurality of adjacent tracks 12 are shown stabily held by the front panel 20 and the rear panel 214. This configuration results in a secure connection of a plurality of tracks 12 within the shelving system 10 such that the individual tracks 12 cannot flop around. The front panel 20 may be attached to the shelf in any suitable manner, including friction fitting or permanent attachment (i.e. a Christmas tree clip 270 as shown in FIG. 2). The side wall 24 of each respective track 12 separates the products supported on individual tracks 12 such that the product carried by one product track 12 will not interfere with the movement of product carried by an adjacent product track 12. As shown, the side wall 24 is integral with the base wall 22. However, the side wall can be a separate divider wall (not shown). It is also appreciated that a product label 272 may be affixed to the front face 164 of the front panel 20.

Figure 10A:
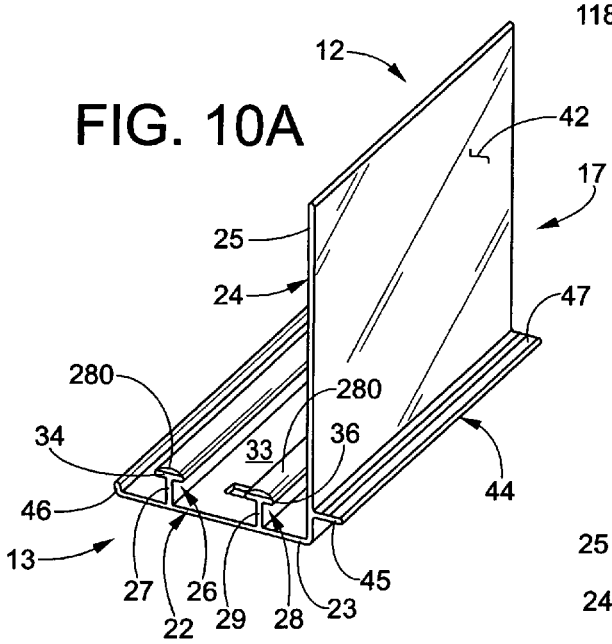
FIG. 10A is a perspective view of an alternate embodiment of the track of FIG. 1A.
Figure 10B:
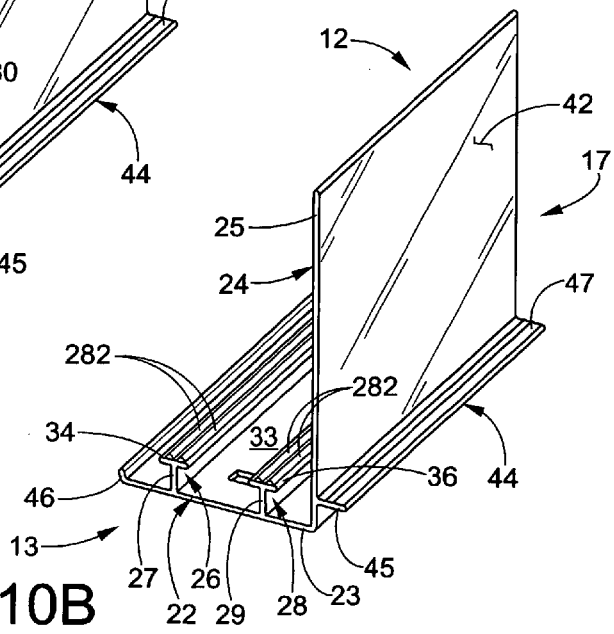
FIG. 10B is a perspective view of another alternate embodiment of the track of FIG. 1A.

With reference again to FIGS. 10A and 10B, the flattened horizontal surfaces 34, 36 can be provided with a single longitudinally extending bump 280 to give the surface a convex appearance and thereby reduce sliding friction of the merchandise supported thereon. Alternatively, the surfaces can be provided with a pair of longitudinally extending spaced ribs 282 for the same purpose. Obviously, the top surface of flange 44 can be similarly configured.

Figure 12:
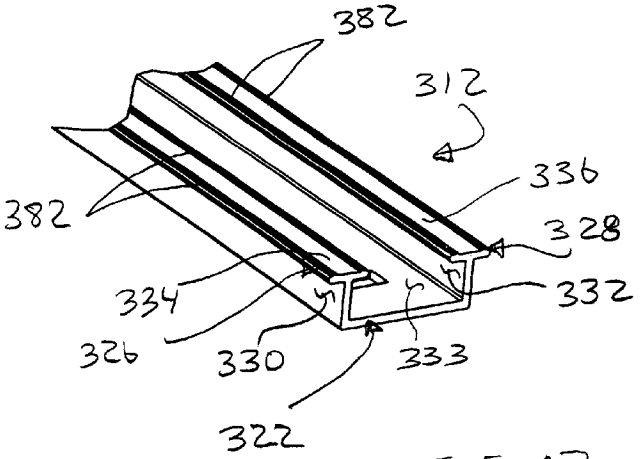
FIG. 12 is a perspective view of a track according to a fourth embodiment of the present invention.
Figure 13:
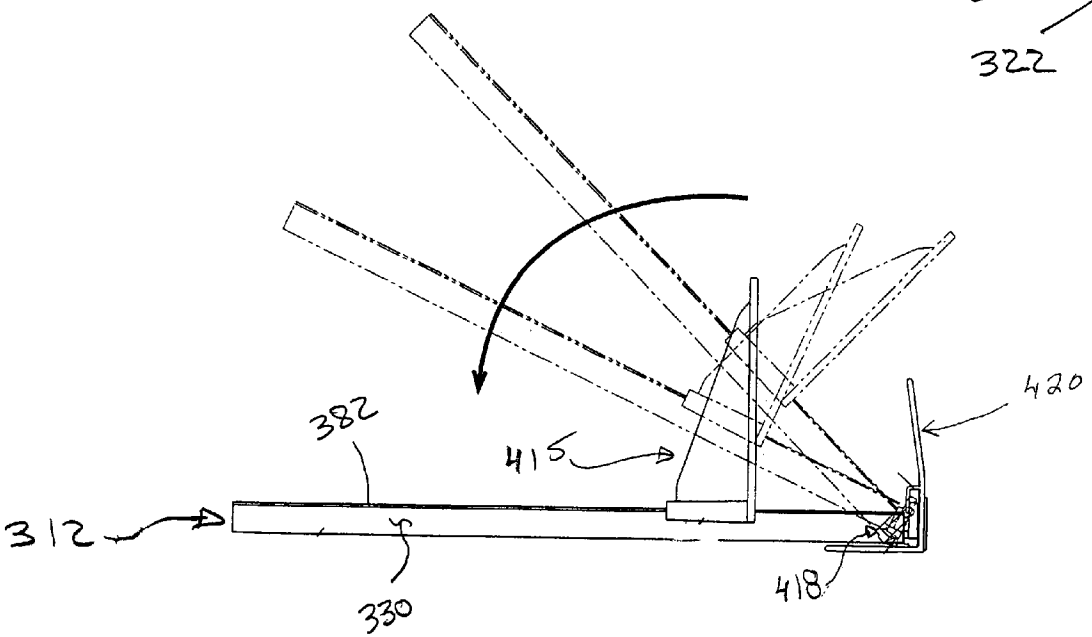
FIG. 13 is a side elevational view of the shelf management system according to the fourth embodiment of the present invention; and, FIG. 14 is an assembled perspective view of the shelf management system according to the fourth embodiment of the present invention.

FIGS. 12 and 13 show a shelf management system in accordance with a third embodiment of the present invention. In particular, a track 312 is generally configured in an elongate orientation. The track 312 includes a base wall 322 with an upper surface 333. The base wall 322 of the track 312 includes a pair of T-shaped rails 326, 328 thereon. The T-shaped rails 326, 328 each include a vertical leg 330, 332, respectively, extending transverse to the upper surface 333 of the base wall 322. The vertical legs 330, 332 each have a flattened horizontal 334, 336, respectively thereon. As shown, the flattened horizontal surfaces 334, 336 are provided with a pair of longitudinally extending spaced ribs 382 to reduce the sliding friction of the merchandise supported thereon.

Figure 14:
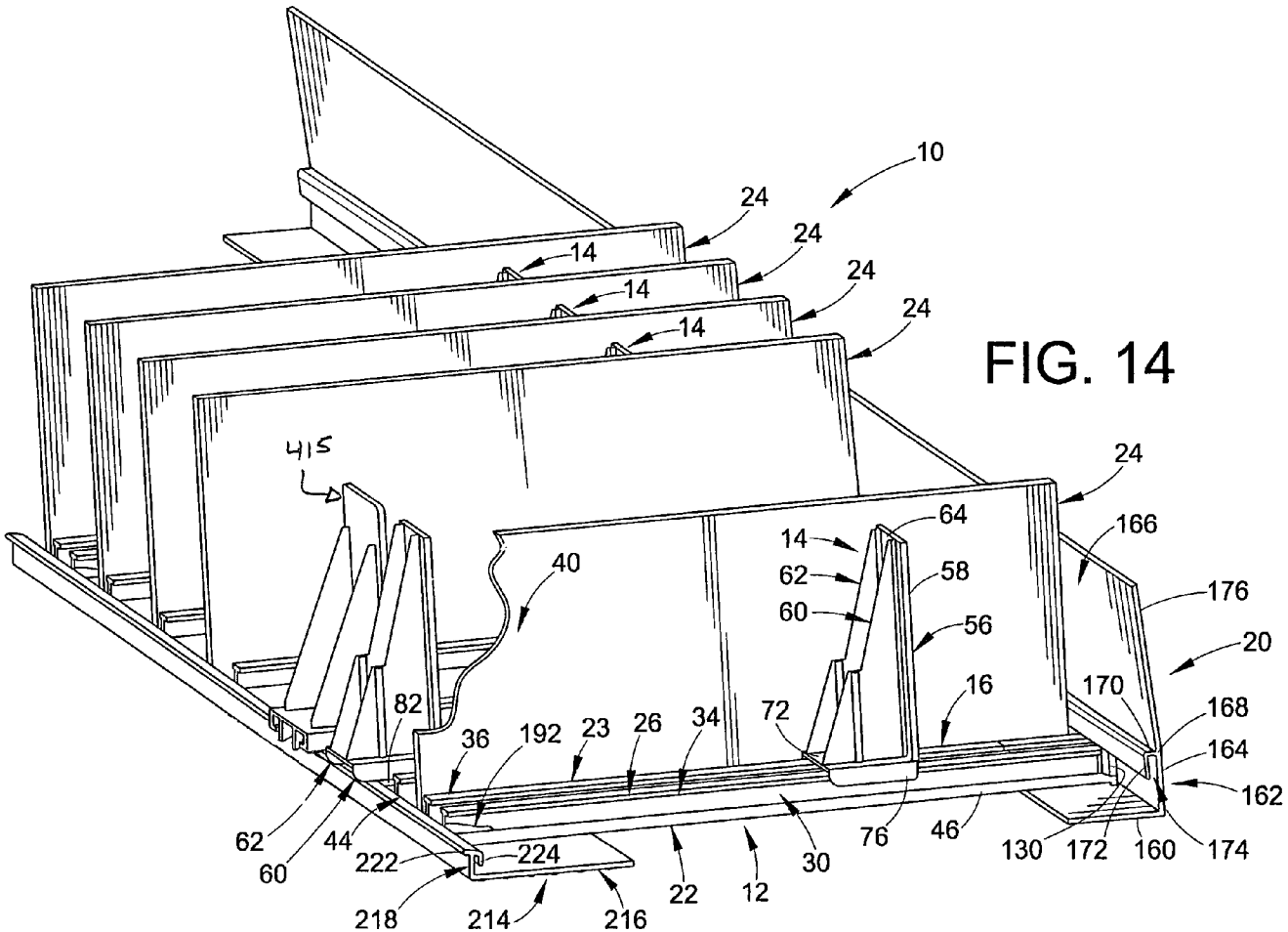

With reference now to FIGS. 13 and 14, the front end clip 418 is shown engaged with track 312. Also shown is paddle 415 mounted on the T-shaped rails 326, 328. It will be appreciated that the front end clip 418 may be hooked in a front panel 420 whereby the track 312 may be pivoted onto the associated shelf so as to lie in a common plane with other tracks. This mounting of an additional track 312 along with an additional paddle 415, assists in pushing an associated product forward on the associated shelf. It is further appreciated that the track 312 is not engaged with the rear panel, thus enabling the second track to be pivoted away from said rear panel for selective removal of the second track from the front panel and the associated shelf, as may be deemed desirable.

The advantages of the present invention include a new and improved shelf management system including a product pusher. The product pusher includes a paddle which is extendible beyond the rear end of a track and is used for urging merchandise items toward the front end of the track. The shelf management system maintains the alignment of the associated products on the track. Additionally, the shelf management system may be quickly installed or rearranged without the need for tools. Furthermore, the present invention provides for a paddle which may be used to extend the usable surface of the track, thereby providing functionality on a plurality of shelves having varying depths.

The invention has been described with reference to several embodiments, obviously, modifications and alterations will occur to others upon a reading and understanding of this specification. It is intended to include all such modifications and alterations insofar as they come within the scope of the appended claims and the equivalents thereof.

Having thus described the invention, it is claimed:

1. A product pusher device comprising:

an elongate track having a front end, a rear end, and a channel;

a paddle movably connected to said track for movement along said channel and having a front face for engagement with a rearmost one of a set of associated products located on said track;

said paddle comprising a foot which is slidably engaged in said channel;

a stop located on said foot;

a coiled biasing element for urging said paddle toward said track front end, said biasing element being supported on said paddle behind said front face; and, wherein said paddle includes a one piece pusher wall which is adapted to cantilever beyond said rear end of said track while said stop limits a rearward movement of said paddle in said channel so that said paddle remains connected to said track.

2. The product pusher device of claim 1, wherein said channel comprises a pair of raised rails each having a generally T-shaped cross-section, said rails having a pair of adjacent edges and a pair of outside edges.

3. The product pusher device of claim 2, wherein said paddle includes at least one set of opposing flanges, wherein said set of opposing flanges captures said outside edges of said pair of raised rails.

4. The product pusher device of claim 2, wherein said pair of raised rails each include a top surface comprising at least one longitudinally extending rib formed thereon.

5. The product pusher device of claim 1 wherein said stop depends from said foot.

6. A product pusher device comprising:

an elongate track having a front end, a rear end, a channel, and a length for placement on an associated shelf having a depth and a length wherein said track extends generally transverse to the length of the associated shelf, wherein the associated shelf has a depth greater than said length of said track, said track supporting a plurality of associated products thereon;

a paddle movably connected to said track for movement along said channel and including:

a front face for engagement with a rearmost one of the associated products positioned on said track, a base on which said front face is mounted, said base comprising a first portion which extends rearwardly of said front face and a second portion which extends forwardly of said front face, said second portion comprising a foot, slidably engaged in said channel, and wherein said paddle front face is of one piece and is adapted to cantilever beyond said rear end of said track while said paddle remains movably connected to said track; and, a biasing element for urging said paddle toward said track front end.

7. The product pusher device of claim 6, wherein said biasing element is mounted on said base.

8. The product pusher assembly of claim 6 wherein at least one of said first and second tracks comprises a rail including a T-shaped cross-section.

9. The product pusher device of claim 6 wherein at least said second portion of said foot remains slidably engaged in said channel when said paddle front face is located beyond said rear end of said track.

10. The product pusher device of claim 9 further comprising a stop and wherein said second portion of said foot engages said stop.

11. A product pusher assembly comprising:

an elongate track;

a channel defined in said track;

a paddle movably connected to said track for movement along said channel, said paddle comprising:

a pusher wall for engagement with an associated product located on said track, a base to which said pusher wall is connected, said base comprising:

a first portion located rearwardly of said pusher wall, and a second portion located forwardly of said pusher wall, wherein at least a portion of said base is located in said channel; and, a biasing element for urging said paddle toward a front end of said track, wherein said pusher wall and said base comprise a one piece member and wherein said pusher wall is configured to be retractable beyond a rear end of said track while said paddle remains connected to said track.

12. The product pusher assembly of claim 11 wherein said biasing element comprises a coiled spring supported on said base first portion.

13. The product pusher assembly of claim 12 further comprising:

a slot located in said base first portion for accommodating a section of said coiled spring.

14. The product pusher assembly of claim 12 further comprising:

a gusset extending between said base first portion and said pusher wall for stiffening said pusher wall.

15. The product pusher assembly of claim 14 wherein a pair of gussets are located adjacent opposed side edges of said base first portion.

16. A product pusher assembly comprising:

a first elongated track having a front end, a rear end, a channel, and a length for placement on an associated shelf having a depth and a length and wherein said track extends generally transverse to a length of an associated shelf;

a first paddle movably connected to said first track for movement along said channel thereof, said first paddle comprising:

a one piece front face for engagement with a rearmost one of a set of associated products positioned on said first track, and a base slidably engaged with said channel; and a biasing element for urging said paddle toward said track front end, wherein said first paddle one piece front face is adapted to cantilever beyond a rear end of said first track while said first paddle remains movably connected to said first track.

17. The assembly of claim 16 further comprising a front panel mounted to the associated shelf and including a wall and a flange which cooperate to define a slot therebetween, and wherein said first track comprises a front clip which is slidably mounted in said front panel slot.

18. The assembly of claim 17 further comprising a rear panel mounted to the associated shelf and including a wall and a flange which cooperate to define a slot therebetween, and wherein said first track comprises a rear clip which is slidably mounted in said rear panel slot.

19. The assembly of claim 18 further comprising a second elongated track having a front end, a rear end, a channel and a length for placement on the associated shelf spaced from and parallel to said first track, said second track comprising a front clip and wherein said second track front clip is slidably mounted in said front panel, but said second track can be pivoted away from said rear panel for selective removal of said second track from said front panel and the associated shelf.

20. The assembly of claim 16 wherein said first track channel is defined by a pair of raised rails, each having a generally T-shaped cross section.

21. The assembly of claim 20 wherein at least one of said raised rails includes a convex top surface.

22. The assembly of claim 20 wherein at least one of said raised rails includes a top surface with a longitudinally extending rib.

23. The assembly of claim 18 wherein said first paddle one piece front face is adapted to cantilever beyond said rear panel.

24. A product pusher assembly comprising:

a first elongated track having a front end, a rear end, and a side wall;

said first track side wall including a first face and a second face;

a flange extending generally transverse to said first track side wall second face, and including a top surface;

a paddle movably connected to said first track for longitudinal movement along said track, said paddle comprising:

a front face for engagement with a rearmost one of a set of associated products mounted on said track, and a base slidably engaged with said track; and a biasing element for urging said paddle toward said track front end, wherein said paddle further comprises a foot which extends forwardly from said front face and wherein said paddle front face is adapted to cantilever beyond said rear end of said first track while said foot remains slidably engaged with said track.

25. The assembly of claim 24 further comprising a second elongate track having a front end, a rear end and a side wall, said second track comprising a pair of raised rails each having a generally T-shaped cross section and a top surface.

26. The assembly of claim 25 wherein said first track flange top surface is coplanar with said top surface of said rails of said second track in order to support a plurality of associated products along said second track.

27. The product pusher assembly of claim 24 further comprising a stop for limiting a rearward movement of said paddle foot.

* * * * *